US008603827B2

(12) United States Patent
Zahlsen et al.

(10) Patent No.: US 8,603,827 B2
(45) Date of Patent: Dec. 10, 2013

(54) TRACER MATERIALS

(75) Inventors: Kolbjørn Zahlsen, Trondheim (NO); Lars Kilaas, Trondheim (NO)

(73) Assignee: Resman AS, Ranheim (NO)

( * ) Notice: Subject to any disclaimer, the term of this patent is extended or adjusted under 35 U.S.C. 154(b) by 389 days.

(21) Appl. No.: 12/500,930

(22) Filed: Jul. 10, 2009

(65) Prior Publication Data

US 2010/0006750 A1 Jan. 14, 2010

(30) Foreign Application Priority Data

Jul. 10, 2008 (NO) ..... 20083095

(51) Int. Cl.
*G01N 37/00* (2006.01)

(52) U.S. Cl.
USPC ..... 436/56; 436/27; 507/203; 166/250.01; 166/250.12

(58) Field of Classification Search
None
See application file for complete search history.

(56) References Cited

U.S. PATENT DOCUMENTS

| | | | | |
|---|---|---|---|---|
| 3,991,827 | A | 11/1976 | Schall | |
| 4,555,489 | A | 11/1985 | Schmitt | |
| 5,077,471 | A | 12/1991 | Smith, Jr. et al. | |
| 5,789,663 | A | 8/1998 | Boger | |
| 6,127,970 | A | 10/2000 | Lin | |
| 6,214,624 | B1 | 4/2001 | Barker et al. | |
| 6,312,958 | B1 | 11/2001 | Meyer et al. | |
| 6,645,769 | B2 * | 11/2003 | Tayebi et al. | 436/56 |
| 6,670,605 | B1 | 12/2003 | Storm, Jr. et al. | |
| 2002/0020527 | A1 | 2/2002 | Kilaas et al. | |
| 2003/0056952 | A1 | 3/2003 | Stegemeier et al. | |
| 2004/0166532 | A1 | 8/2004 | Keller | |
| 2006/0008850 | A1 | 1/2006 | Riggs-Sauthier et al. | |
| 2006/0052251 | A1 | 3/2006 | Anderson et al. | |
| 2006/0154297 | A1 | 7/2006 | Gauchel | |
| 2007/0241277 | A1 | 10/2007 | Stray et al. | |

FOREIGN PATENT DOCUMENTS

| | | |
|---|---|---|
| EP | 0 816 631 | 1/1998 |
| WO | 00/63531 | 10/2000 |
| WO | 01/81914 | 11/2001 |
| WO | 01/92865 | 12/2001 |
| WO | 02/075307 | 9/2002 |

OTHER PUBLICATIONS

Wikipedia retreived from internet: http://en.wikipedia.org/wiki/Polypropylene_glycol.*

Wikipedia, 2007, retreived from internet: http://en.wikipedia.org/wiki/Polypropylene_glycol.*

International Search Report (in English language) issued Nov. 18, 2009 in corresponding International Application No. PCT/NO2009/000260.

(Continued)

*Primary Examiner* — Robert Xu

(74) *Attorney, Agent, or Firm* — Wenderoth, Lind & Ponack, L.L.P.

(57) ABSTRACT

A tracer system comprising a tracer compound for a fluid system, the tracer compound comprising one or more polyether alcohol compounds. The one or more polyether alcohol compounds is arranged for being placed in contact with a first part of said fluid system. The one or more polyether alcohol compounds is truly monodisperse. The polyether alcohol compounds comprises one or more functional groups. The one or more truly monodisperse polyether alcohol compounds is arranged for being detected in a second part of the fluid system in fluid communication with said first part of said fluid system. The tracer compound is detectable in very low concentrations.

19 Claims, 4 Drawing Sheets

Figure 4A:
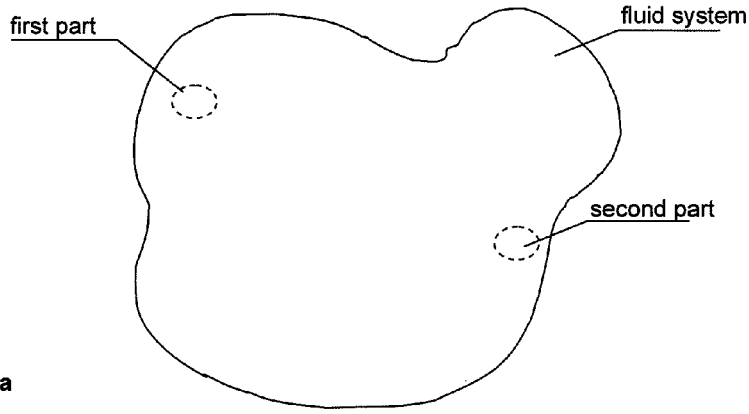

Example of coded combination [5, 7, 10] of $k$=3 truly monodisperse polyethylene glycol compounds, out of $n$=7 available, from oligomer #5 to oligomer #11.

(56) References Cited

OTHER PUBLICATIONS

Patent Cooperation Treaty (PCT) Written Opinion of the International Searching Authority (in English language) issued Nov. 18, 2009 in corresponding International Application No. PCT/NO2009/000260.

International Search Report issued in the International (PCT) Application of which the present application is the U.S. National Stage, Nov. 18, 2009.

* cited by examiner

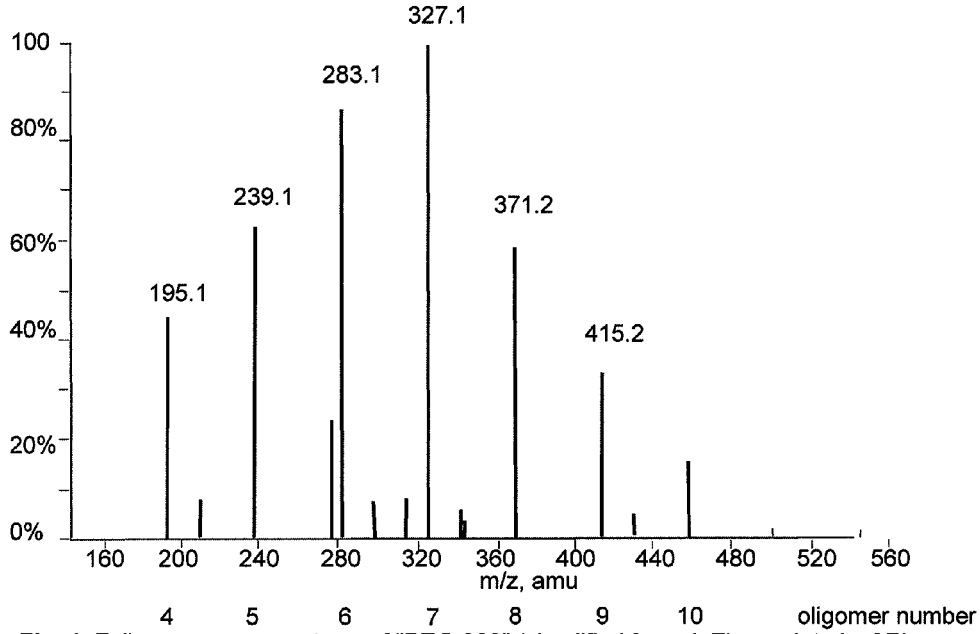
Fig. 1: Full scan mass spectrum of "PEG 300" (simplified from J. Zhang, Int. J. of Pharm. 282, 2004, pp 183-187, and modified) The values for m/z represent protonated molecules (M +H+)
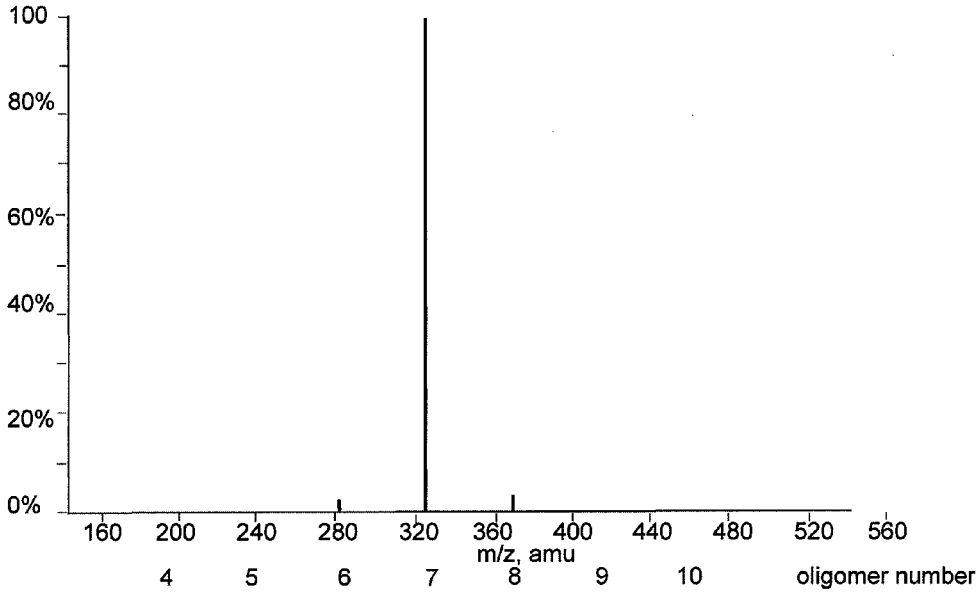
Fig. 2: Illustration example of mass spectrum of truly monodisperse polyethylene glycol, (n=7, m/z=327,1 for H+ adduct), purity 95%

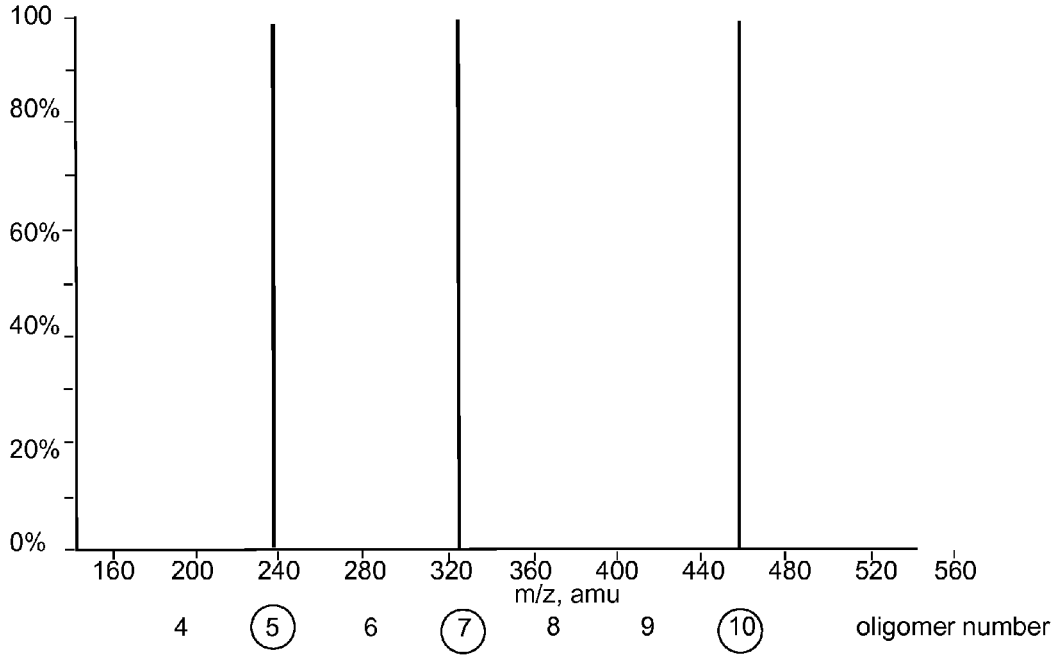
Fig. 3: Example of coded combination [5, 7, 10] of $k$=3 truly monodisperse polyethylene glycol compounds, out of $n$=7 available, from oligomer #5 to oligomer #11.

TRACER MATERIALS

INTRODUCTION

Tracer materials have a large and indeed expanding area of use, as they now may serve in a large number of applications and in a large number of fields. The use of tracers may be found in almost all technical fields, and are of interest as to the precise measuring of occurrences both industrial and other. The development of novel tracer materials is thus of major practical interest, and the present invention presents a new class of tracer materials.

Petroleum exploration and production remains a centrepiece of the modern economy of the world, and is one of the determining economic input factors worldwide. A large number of oilfields are however ageing, and are approaching the tail end of their production life cycle. This is often marked by a number of changes in well conditions such as drops in pressure, and more importantly an increasing influx of water into the production fluids. The influx of water into the production fluids is of importance as this increases the cost of production, and necessitates large and costly separation facilities for the adequate treatment of the produced fluid. Consequently it would be of major practical importance to establish whether a formation water breakthrough has occurred in petroleum production tubing or conduit, and not the least to determine at which point this influx has taken place. Tracers may in particular serve to detect such occurrences, and in particular the use of the hereinafter described novel class of tracer materials will be of particular interest.

Water production is one of the major technical, environmental and economical problems associated with oil and gas production. Water inflow can limit the productive life of the oil and gas wells and can cause severe operational problems including corrosion of tubular, fines migration, sand production and hydrostatic loading. In environmentally sensitive areas such as in the Barents Sea, reliable monitoring systems are critical. Leakage of oil and wastewater is not an option. Thus, future monitoring systems must be simple and reliable. Although many field developments are planned with monitoring technology, only a small number of fields are actually monitored due to lack of available technology and/or cost. The most commonly used monitoring technologies are production logging (PLT) using conventional wireline tools, various permanent downhole systems, e.g. DTS (distributed temperature sensing) and permanent gauges based on fibre optic technology. A common problem is that downhole sensors and gauges do not work properly, forcing the operator to run frequent wireline logging operations, or install other costly retrofit solutions.

Modern off-shore installations are usually connected to a quite large number of production wells, and each well may comprise a number of subsidiary wells. To monitor the well production, that is to determine fluid inflow, e.g. oil, gas and water production, along the well, is getting more and more complicated and important. To ensure optimisation of the recovery in the field it is of major importance to know the production of oil, gas and water along the well. The flow patterns within the reservoir, and the detection of same is often difficult to ascertain. Given the necessary tools however, the understanding of the reservoir will be much improved and increase the economic output from the well. Given that drilling operations are very costly, the understanding of a reservoir is crucial in order for the correct placement of secondary wells, of the drainage schemes, of pressure control in the reservoir, in short in order for adequately controlling the reservoir.

Although it has proven possible to determine that a water intrusion has taken place, it has proven difficult to localise the position of the water breakthrough along the well bore and possibly within the subsidiary well, such that adequate measures can be taken. Measures may include shutting down the specific pipe length that has been influenced or indeed shutting down entire production pipe sections if workover needs to be performed. However, the information necessary to determine the precise location of entry point of fluids such as water, oil, gas or a mixture of these fluids has up until now been unavailable. The present invention will seek to resolve this question using said novel class of tracer materials.

The present invention describes the use of a novel tracer material comprising truly monodisperse polyether alcohol compounds, e.g. Polyethylene Glycol (PEG)/Polypropylene Glycol (PPG) etc. and their derivates as tracers. The advantages of the novel tracer material will be discussed, and beneficial uses thereof will be disclosed.

BACKGROUND ART

There have been many attempts at using tracers to characterize hydrocarbon wells, the most relevant being discussed in brief below.

Present methods for detecting water intrusion include the use of fluorescent materials, radioactive materials, peptides and amino acids amongst others. However these compounds are not always easily detectable in low concentrations.

WO0181914 concerns a method for monitoring the hydrocarbon and water production from different production zones in a hydrocarbon reservoir or injection wells and detection of different phenomena such as e.g. local variations in pH, salinity, hydrocarbon composition, temperature, pressure, micro organisms, and the difference/ratio between production of formation and/or injection water from various zones in a hydrocarbon reservoir. The method comprises dividing regions around wells in the reservoir into a number of sections, and injecting or placing specific tracers with unique characteristics for each section into the formation in these regions. The tracers are chemically immobilized/integrated in the formation or in constructions/filters around the wells, the tracers (tracer carriers) being chemically intelligent and released as a function of specific events. Detecting the tracers after the entry point, provides information about the various zones. There is solely mention of PEG-materials being part of the carrier material.

U.S. Pat. No. 4,555,489 describes a method for determining flow patterns within a subterranean formation penetrated by a spaced apart injection system and production system that comprises injecting into the formation at a predetermined depth from the injection system a solution containing a small amount of one or more water-soluble tracer compounds, recovering said tracer in the production system, determining the depth of recovery, and identifying said tracer compounds by gas chromatography and flame ionization detector; said tracer compounds being water-soluble organic compounds having phosphorus, nitrogen, or sulphur in the molecule.

WO2007132137 describes a method for the characterization of hydrocarbon reservoirs using biological tags.

U.S. Pat. No. 5,077,471 describes a method wherein formation fluid flows in earth formations opposite a perforated well bore zone are measured and monitored by injecting radioactive tracers into the perforations, blocking the perforations to retain the tracers in the formation, monitoring the apparent decay rates of the injected tracers, and then determining the rate at which the tracers are being carried away by fluid movements in the formation. From this the flow rate of the fluids in the earth formations adjacent the borehole interval is inferred.

U.S. Pat. No. 6,670,605 describes a method wherein a formation fluid analysis module utilizes a down-hole mass spectrometer to determine the molecular constituents of formation fluids, as distinguished from drilling contaminants, and to provide information about the physical and chemical properties of the sample.

U.S. Pat. No. 5,789,663 describes a method for quantitatively measuring the characteristic physical parameters of a porous medium, such as an aquifer that is initially recharged at a recharge rate and subsequently discharged at a discharge rate by a pumped fluid utilizing a single well into which a tracer is injected during recharge, and at which the tracer is subsequently detected during discharge. A measurement of the elapsed time, together with a formula based on a convective physical model relating the characteristic parameters to the time measurements is provided.

The use of PEG tracers has to some degree been discussed in various journals. Analytica Chimica Acta Volume 611, Issue 2, "A solid-phase extraction and size-exclusion liquid chromatographic method for polyethylene glycol 25 p-aminobenzoic acid determination in urine: Validation for urinary excretion studies of users of sunscreens" for instance describes the detection of a PEG derivate in sunscreen such that the detection of sunscreen levels in human urine is allowed. However PEG compound is not used as a tracer, it is a naturally occurring compound in the sunscreen.

Commercially available polymer products are usually prepared in a way that gives a broad range of molecular weight. Molecular weight can be measured as an average by weight or number and the ratio between these, $M_w/M_n$, s called the breath of the distribution. Most polymers made by free-radical or coordination polymerization of vinyl monomers have ratios from 2 to about 10, while very highly branched polymers like polyethylene made by free-radical, high pressure processes, will have ratios of 20 and more.

Poly ethylene glycol (PEG) is the most commercially important type of polyether. Polypropylene glycol (PPG) is another polyether with many properties in common with PEG. PEG has the following structure, $HO—(CH_2—CH_2—O)_n—H$ . Most PEGs include molecules with a distribution of molecular weights, i.e. they are polydisperse. The abbreviation (PEG) is usually termed in combination with a numeric suffix, such as "PEG 300" which indicates the average molecular weights. For an illustration of such a polydisperse PEG, please see FIG. 1 attached, which is a full scan mass spectrum of "PEG 300" simplified from J. Zhang, Int. J. of Pharm. 282, pp. 183-187. FIG. 1 shows the composition and distribution of PEG 300, having an average molecular weight of 300, which mostly includes oligomers represented by n=5 to 9. Products are commercially available as PEG 200, 300, 400 etc up to more than 20000.

US 2006/0154297 from Gauchel, "Marker substance and the use of the same in diagnostic methods", teaches a method for using PEG markers as non-metabolisable marker substances together with a metabolisable substance in a diagnostic method related to e.g. drug-addicted patients. The two different types of markers present in a drinkable solution, is administrated to the patient followed by analysis of the urine taken after 60 minutes. The method further describes analysis of the urine sample by use of a HPLC chromatographic separation in combination with RI detection of the PEG fraction followed by UV detection of the metabolisable marker. Throughout the application Gauchel refers to the "PEG-marker" in plural form implicating use of polydisperse PEG's/PEG fractions. This is clearly seen by use of terms as "added to non-metabolisable marker substances", together with PEG markers" and "containing 1-3 g PEG marker mixture". A chromathogram of PEG 300 shown in FIG. 2 of Gauchel clearly indicates that this PEG substance constitutes of more than 9 different PEG oligomers of different molecular weights. Gauchel also refers to use of "monodisperse PEG fractions". Thus Gauchel uses the term "monodisperse" somewhat differently from what is used in polymer chemistry.

US patent application US 2006/0008850 A1 describes a method for generating a library of monodisperse PEG derivatives. This method of using "combinatorial chemistry or combinatorial synthesis" is a well known technique and is a general approach for generating a large number of different molecules, e.g. for making peptide libraries. The same approach for generating functionalized PEG's with both hydrophilic and hydrophobic end groups is also mentioned. The libraries so formed are used for screening the effect of PEG length, functional end groups and type of drug attached to the PEG moiety in order to isolate potent substances for use as therapeutics.

Thus, none of the abovementioned applications describe the novel tracer material comprising generally monodisperse polyether alcohols for marking and low concentration detection as will be described below. In order to distinguish the compounds of the present invention from the actually non-monodisperse or polydisperse polyether alcohol compounds of the background art, we have chosen to use the term truly monodisperse when describing the polyether alcohol compounds.

SHORT SUMMARY OF THE INVENTION

In a first aspect the present invention discloses a tracer system comprising a tracer compound for a fluid system, in which the tracer compound comprises one or more polyether alcohol compounds, and in which the one or more polyether alcohol compounds is arranged for being placed in contact with a first part of said fluid system. Further, each of the one or more polyether alcohol compounds is truly monodisperse, and the polyether alcohol compounds comprise one or more functional groups. The one or more truly monodisperse polyether alcohol compounds is arranged for being detected in a second part of said fluid system in fluid communication with said first part of said fluid system.

In a preferred embodiment the tracer system comprises a tracer compound for a fluid, in which the fluid is subject to potential changes in conditions. The tracer compound is arranged in contact with the fluid, and the tracer compound is arranged for being released to the fluid as a response to a change in the conditions of the fluid. The tracer compound comprises one or more functional groups in one or more truly monodisperse polyether alcohol compounds.

In one embodiment the tracer compound is arranged in a matrix which may be arranged in contact with the fluid.

In a preferred embodiment of the invention the tracer system comprises two or more distinct combinations of monodisperse polyether alcohol compounds.

In another aspect, the invention is a method for tracing a tracer compound in a fluid system. The tracer compound comprises one or more polyether alcohol compounds. The method includes that one provides one or more truly monodisperse polyether alcohol compounds, of which the one or more truly monodisperse polyether alcohol compounds has one or more functional groups. The method further includes placing one or more of the one or more truly monodisperse polyether alcohol compounds in contact with a first part of said fluid system, taking a sample from a second part of said fluid system, and analyzing the sample using an apparatus for determining the presence, or not, of the one or more truly monodisperse polyether alcohol compound in the fluid sample.

In a preferred embodiment according to the invention, the method includes arranging the one or more functional groups for releasing the truly monodisperse polyether alcohol compound to the first part of the fluid system.

Further, the method according to the invention may include preparing one or more of the truly monodisperse polyether alcohol compounds for being released to the first part of the fluid system upon a predetermined change in the fluid systems conditions. The predetermined change in the fluid system's conditions may occur at the first part of said fluid system.

In an embodiment of the invention the truly monodisperse polyether alcohol compound are mixed into the first part of the fluid system when placed in contact with the first part of the fluid system.

The number of the truly monodisperse polyether alcohol compounds may be two or more. In an advantageous embodiment of the invention the method may further include preparing two or more distinct combinatorial combinations of one or more of the two or more truly monodisperse polyether alcohol compounds.

In an advantageous embodiment of the invention the method includes arranging the one or more truly monodisperse polyether alcohol compounds in one or more matrixes, placing one or more of said matrixes in contact with said first part of said fluid system.

A predetermined change in conditions may comprise a water intrusion into a petroleum production pipe.

The invention further discloses the use of a tracer system for the supervision of well integrity in a petroleum production well.

The invention further comprises the use of a tracer system for well to well tracing.

The invention further discloses the use of a tracer system according to claim for the determination of an entry point of a fluid component in a conduit, said conduit arranged for receiving fluids and relaying said fluids to a desired point, said conduit being divided into conduit sections wherein each conduit section is provided with a specific combination of truly monodisperse polyether alcohol compounds arranged along the conduit length according to a defined scheme, wherein said specific combination of species of truly monodisperse polyether alcohol compounds is arranged for being released upon contact with the fluid component to be detected, wherein each combination comprises two or more distinct truly monodisperse polyether alcohol compounds, wherein said specific combination of truly monodisperse polyether alcohol compounds are entrained by the fluid stream within the conduit, wherein a detection apparatus is arranged for detecting said specific combination of truly monodisperse polyether alcohol compounds within the fluid stream thus detecting the fluid component in the conduit and determining the conduit section allowing the entry of said fluid component.

SHORT FIGURE CAPTIONS

Some of the background and the invention is illustrated in the attached drawing figures, of which FIG. 1 is a simplified drawing of a full scan mass spectrum of "PEG 300" redrawn from J. Zhang, Int. J. of Pharm. 282, pp. 183-187, FIG. 2 is a similar simplified drawing of a scan mass spectrum of a truly monodisperse polyethylene glycol with molecular weight 326, 1 $(HO—(CH_2CH_2O)_7—H$.

FIG. 3 is an simplified illustration of a coded combination [5, 7, 10] of k=3 truly monodisperse polyethylene glycol compounds. out of n=7 available, which may represent a specific marker code "0101001".

FIG. 4*a* to d provides simplified illustrations of different fluid systems in which the tracer system of the invention may be employed: a) a very generalized fluid system, b) a petroleum fluid system with an injector and a production well, c) a production well with several producing sections and entry points, and d) a river system.

DESCRIPTION OF EMBODIMENTS OF THE INVENTION

Tracer compounds for fluids should in general exhibit a number of desirable properties, and at least two major criteria:

It should be released due to a predetermined or predefined condition one wishes to detect, It should be detectable in low concentrations.

Additionally the tracer should exhibit other desirable properties, some of which are listed below:

It should be easy to concentrate up to desired concentrations it should according to the present invention be codable it should exhibit low toxicity it should be priced reasonably it should exhibit predictable properties.

Monodispersity is the state of uniformity in molecular weight of all molecules of a substance, or of a polymer system. Mono as for one, and dispersity as for distribution or spread, meaning all molecules in the product have the same molecular weight. A truly monodisperse polymer has Mw/Mn near to 1.0, please see FIG. 2 which is an illustration of a scan mass spectrum of a truly monodisperse polyethylene glycol having a purity of more than 95%. The mass spectrum is entirely dominated by oligomer number 7. The tracer system according to the invention comprises a tracer system comprising a tracer compound for a fluid system, of which the tracer compound comprises one or more polyether alcohol compounds. The one or more polyether alcohol compounds is arranged for being placed in contact with a first part of said fluid system. FIG. 4*a* Illustrates very generally a fluid system in which the tracer system of the invention may be used. The one or more polyether alcohol compounds are truly monodisperse. The truly monodisperse polyether alcohol compounds comprise one or more functional groups. The one or more purely monodisperse polyether alcohol compounds are arranged for being detected in a second part of fluid system in fluid communication with the first part of the fluid system. The tracer system according to the invention discloses all the above mentioned properties. In contrast to Gauchel, the present invention teach use of truly monodisperse PEG oligomers/polymers as tracers, where the monodispersity makes it possible to design unique tracers due to the specific size, and hence unique molecular weights.

The term "fluid" as used in this description comprises liquids,gases or mixtures thereof, and possible solid components if some of the fluid system's components are below their liquid temperature.

Polyether alcohol compounds have been described, albeit not as tracer materials. One of the novelties according to the present invention lies in that one is able to detect very low levels of tracer material. This allows for the monitoring of fluid streams or volumes being very large without having either to replace the tracer material after a short time, or having to provide important volumes of tracer material. The definition of providing very low concentrations is in this regard might reach sub ppb. The detection methods will be described in more detail below.

The tracer system should be arranged for responding to a change in conditions, whereupon said one or more truly monodisperse polyether alcohol compounds are arranged in a first part of the fluid system, or in contact with a first part of the fluid system. The tracer according to the invention may advantageously be arranged in a matrix or on a material component such as a channel wall for being released from the matrix or the mechanical component to the fluid, such that said change in conditions upon detection of said truly monodisperse polyether alcohol compounds is shown to have occurred. These changes in conditions may comprise a number of various occurrences including but not limited to the entry of water into a fluid system, a change in temperature, pressure, salinity, pH, composition, a mere displacement or transport of the fluid in the fluid system, or the like.

In an embodiment of the invention said one or more truly monodisperse polyether alcohol compounds mainly comprises polyethyleneglycol PEG or derivates thereof.

PEG as such has been used as a carrier for other molecules, and is in use for various pharmaceutical uses. Many of the properties rendering PEG useful in pharmaceutics such as its low toxicity and its water solubility are useful for tracing molecules.

PEG compounds exhibit all the abovementioned properties with respect to tracers. It is very well adapted for the tracing of water and may furthermore be tailored such that it exhibits these advantageous properties with respect to other compounds as well.

It has furthermore been noted that PEG may be produced such that they are monodisperse allowing the production of the polymeric molecules having a specific defined molecular weights. Lastly it has been proven that the pegylation of other molecules is quite simple, and thus that functional groups of various types may be attached to the PEG polymers such that one renders the molecules hydrophobic or hydrophilic.

PEG compounds have been studied thoroughly in the art, and their properties are well known. The applicant has previously used PEG tracers for detection of water influx into oil production wells, and they have been proven to work in a satisfactory manner.

Although the method according to the invention will have its main focus on the monodisperse PEG derivates other chemicals within the class of polyether alcohols are encompassed by the present invention as long as the are truly monodisperse. Monodisperse polymeric chemicals are in production today having very narrow molecular weight distributions, such that they are practically monodisperse, and although PEG is advantageous from many points of view, the method according to the invention is not limited to the use of PEG. According to an embodiment of the invention the tracer system comprising said one or more truly monodisperse polyether alcohol compounds mainly comprises polypropyleneglycol or derivates thereof.

In an embodiment according to the invention, a polymer matrix may be provided such that the tracer system is immobilised within the matrix, and is solely released upon a specific condition being fulfilled. The matrix as such may be constituted from any apt material, and is as such not an object of the present invention. The matrix as such will protect the tracer system such that it is not washed out to early, or the matrix may be such arranged that it only responds to certain conditions, whereupon the conditions being met, the tracer is released.

According to an embodiment of the invention the number of monomer groups [—($CH_2CH_2O$)—] comprised in the one or more truly monodisperse polymeric compounds is above 3. Increasing the number of repeating units, will to some degree change the properties of the tracer material, but will also allow the furnishing of an increased number of tracer materials. This is of practical interest as increasing number of tracer materials allows increased tracer resolution. This might further allow the reduction of the number of combinations of materials thus facilitating the analysis of the sample within the detection apparatus. By tailoring the properties of the polyether alcohols of increased length by adding functional groups, one should reduce the drawbacks of them having slightly different properties due to their number of repeating units.

Throughout the present application usage is made of terms such as increasing or decreasing the hydrophilicity/lipophilicity of the tracer compound. It should be understood that the increase/decrease as described refers to comparisons with the associated native polyether alcohol compounds.

Most native polyether alcohol compounds such as PEGs are easily water soluble and may thus be well adapted for the monitoring of water influx. This is of particular interest for monitoring for instance petroleum production wells for water influx, thus allowing the operator to identify the influx of water such that a section of piping may be closed off to reduce required oil water separation operations on deck. However native PEGs have a certain solubility in oil as well, and for this class of detection methods, efforts should be made to render the PEG derivates non-soluble in oil. Due to this fractionation, one may also use native PEGs that is partly soluble in oil to monitor oil production as long as the release system ensure sufficient tracer amounts to the oil phase in absence of a water phase.

To resolve this issue, one may modify said PEG-derivates such that they comprise functionally very different PEG-derivates having functionally diverse groups such as carboxylic acids, sulphonic acids, phosphonic acids or combinations thereof. Other functional groups may be added according to need as will be evident to a person skilled in the art. The salts of such derivates are particularly well adapted for tracers for water indication. Both monoacids and diacids of said PEG derivates may serve, and this will evidently increase the number of PEG derivates and thus tracers which may be used and be detected by mass.

For hydrophilic tracers the monodisperse polymeric compounds may thus comprise functional groups amongst others chosen from one or more of the following groups primary, secondary, tertiary, and/or quaternary amines, zwitterionic molecules, hydroxyls, carboxylic acids, sulphonic acids, phosfonic acid, amides or salts thereof. The invention covers, but is not limited to the above mentioned chemical groups.

Some examples are shown below of derivates which may be generated.

$$Xi\text{-}Cn\text{-}O\text{—}[CH_2\text{—}CH_2\text{—}O]_m\text{-}Cy\text{-}Zj$$

In this configuration, X and Z may be functional groups of the same configuration or be different, n and y are integers larger than or equal to 0. m must be an integer, usually comprised within 1-50 but may also be larger. The groups X and or Z are in an embodiment of the invention hydrophobic groups if oil soluble tracers are wished for, however they are hydrophilic if water soluble groups are intended. The groups X and Z need evidently not be identical. The groups X and Z may also be present in a number higher than 1 as indicated by the integers i and j. Cn and Cy may also be of aromatic origin with hydrophilic substituents for water soluble tracers or of aromatic origin with hydrophobic substituents for oil soluble tracers. An other example of Cn and Cy is triazolines Any type of hydrophilic or hydrophobic groups may be used. However the truly monodisperse Polyether alcohol moiety constitutes the "body" of the molecules.

A more general formula for tracer molecules may be:

$$X\text{-}A\text{-}O\text{—}[CH_2\text{—}CH_2\text{—}O]_m\text{—}B\text{—}Z$$

Where A and B may be any organic or inorganic or a hybrid moiety.

According to an embodiment of the invention, the functional groups of the tracers may be hydrophilic, such as monodisperse aminated PEG groups, wherein the amino groups may be reacted with further groups as per the example shown below for generating hydrophilic molecules. Both symmetrical or non symmetrical molecules may be used as well as functionalized mono-OH-PEG's. Non exhaustive examples are given below GroupZ—NH-Cn-O—$[CH_2\text{—}CH_2\text{—}O]_m$-Cy-NH—GroupZ GroupZ—CONH-Cn-O—$[CH_2\text{—}CH_2\text{—}O]_m$-Cy-N HCO—GroupZ GroupX—NH-Cn-O—$[CH_2\text{—}CH_2\text{—}O]_m$-Cy-NH—GroupZ GroupX—CONH-Cn-O—$[CH_2\text{—}CH_2\text{—}O]_m$-Cy-NHCO—GroupZ H—O—$[CH_2\text{—}CH_2\text{—}O]_m$-Cy-NH—GroupZ H—O—$[CH_2\text{—}CH_2\text{—}O]_m$-Cy-NHCO—GroupZ Group Z and or X may be any organic, inorganic compound or a combination thereof such as, but not limited to, —$(C)_kCOOH$, —$(C)_kSO_3H$, —$(C)_kPO_3H$ or salts of the mentioned ligands.

According to an embodiment of the invention, the functional groups of the tracers may be hydrophobic, Hydrophobic groups may be aromatic hydrocarbons such as benzene and derivatives thereof, heterocyclic aromatics (heteroaromats) e.g pyridine, imidazole, pyrazole, oxazole, thiophene, and their benzannulated analogs (benzimidazole, for example). Other types of ligand may be Polycyclic aromatic hydrocarbons (PAH). Examples may comprise naphthalene, anthracene and phenanthrene. In this manner various oil soluble compounds/tracers may be manufactured and the detection of oil influx will be rendered possible.

According to the present invention one may add lipophile groups such as alcanes or aromatic groups, and it is even possible to adjust such molecules according to the crude oil which is to be detected. This is a surprising effect of the invention, wherein an initially hydrophilic trace is rendered lipophilic by the addition of functional groups such that it may detect other compounds not being water soluble, before the removal of the functional groups for subsequent analysis.

The degree of hydrophobicity may be tailored by the addition of very hydrophobic compounds to the polymer chain. Although hydrophobic compounds are not very well adapted for separation and detection in a LC/MS system, one may use breakable bonds between the hydrophobic compounds and the functional end groups. Thus a pre-treatment of the oil sample may be necessary in order for the native PEG derivates to be reconfigured. This may be performed on-site or in vitro at laboratories. The oil sample may furthermore be extracted using water to isolate the water soluble PEG derivates for later concentration and detection.

In this manner the tracers may serve as tracers for the detection and monitoring of hydrocarbon influx such as oil and/or gas, thus allowing reservoir monitoring to a degree hereto unknown in the art. Given that the detection of the tracers may be performed even at very low levels of tracer, this implies that the tracer materials may be durable with respect to the oil such that the tracers will be long lasting and provide long term monitoring of the oil influx into the well.

In general all types of hydrophobic ligands ($R^1$ and $R^2$) may be used:

$$R^1\text{—}O\text{—}[CH_2\text{—}CH_2\text{—}O]_m\text{—}R^2$$

in which $R^1$ and $R^2$ can be the same or different and m is an integer number.

As hydrophobic groups are more difficult to detect whilst using one of the detection methods according to the invention, an object of the present invention is to describe modified polyether alcohol compounds wherein these have been modified by introducing hydrophobic protection groups. The hydrophobic protection groups need to fulfil a number of criteria, one of them being that they should be separable from the hydrophilic base tracer compound using known chemical methods such as separation by acid or base treatment.

Protection groups as defined according to the present invention as intermediate functional groups which are arranged for protecting one or more groups of a compound during a synthesis step or steps. In this context protection groups may be arranged for protecting either the polyether alcohol compounds, or other portions of the tracer material. Protection groups as such are well described in the art, and any use thereof as understood by a person skilled in the art should be considered as being par of the invention.

In organic synthesis effective use of protecting groups is very important to a synthetic strategy. A useful protecting group must have the following properties:

- the protective agent must selectively react with the functional group that requires protection.
- the protective group must be introduced in high yields, without side reactions.
- the protected functional groups should be stable against a variety of reactions.
- the protective group should be capable of being selectively deprotected under specific conditions that are not adverse to the integrity of the protected compound.

The list below encompasses a wide range of protective agents, from those that provide conventional protecting groups (TMS, Boc, trityl amongst others) to a special protective agent, 1,2-bis(chlorodimethylsilyl)ethane which reacts only with aliphatic primary amines to generate azadisilacyclopentane derivatives. One may envisage Alcohol protecting groups such as Acetyl (Removed by acid or base) or β-Methoxyethoxymethyl ether (removed by acid, or Amine protecting groups comprising Carbobenzyloxy group (Removed by hydrogenolysis) or tert-Butyloxycarbonyl (Removed by concentrated, strong acid), Carbonyl protecting groups comprising Acetals or ketals (removed by acid), Carboxylic acid protecting groups comprising Methyl esters (Removed by acid or base) or Benzyl esters (Removed by hydrogenolysis), or other protection groups. The interested reader is referred to relevant literature or information freely available such as in sites such as http://en.wikipedia.org/wiki/Protecting_group#cite_note-0#cite_note-0 from which the information above is partially derived.

The method according to the invention further comprises using incorporating fluorescent tracers based on for instance phenyls, biphenyls, naphtalene groups and so on, wherein one chemically bonds various polyether alcohol groups such as PEG derivates to these. In this manner one may achieve a combination of fluorescent properties with ease of detection using mass spectrometry.

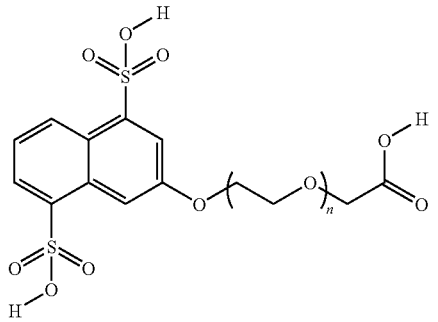

The carboxylic acid group may be substituted with e.g. sulfonic acid, phosfonic acid and salts thereof. Amid groups may also be incorporated in the molecules. The monodisperse PEG moiety may be linked through any type of linkage (bond) The ligand having e.g. fluorescent properties can be any organic or hybrid type of structure Experimentation has shown that derivates of carboxylic acids and sulphonic acids show surprisingly good separations on C18 columns equalling or even surpassing that of native PEG derivates.

In the above described manner a very large number of tracers may be generated if a combination of various polyether alcohol derivates such as PEG derivates are used in combination instead of using a single specific tracer compound. By using separate compounds having chemically similar properties they will behave in roughly the same manner and the initial amount of each tracer will be maintained during the entire monitoring phase.

In an embodiment of the invention the functional group comprises a second polymer. This second polymer should comprise a defined number of monomers, and thus clearly be identifiable by the operator. Adding a second polymer as defined here will increase the number of possible permutations of tracer material, and will follow the generic formula. The mass difference between the tracers being defined by the polyether alcohol length, the addition of further polymers to the polyether alcohol compound merely increases the number of permutations possible. In some instances, protection groups may be provided for the protection of these secondary polymers.

Detection Methods

The present application describes a method for the detection of different monodisperse compounds such as polyethylene glycol derivates or the like wherein the method is arranged for measuring the presence of specific combinations of the compounds. The truly monodisperse polymeric compounds are arranged in fluid contact with a stream into which one may presume that at a given time an influx of a compound one wishes to monitor may occur. Upon the influx having occurred there should be the possibility of detecting the combination of tracer compounds such that one may quite accurately pinpoint the location of the influx. If the main stream to be monitored has a large fluid flux, this entails that the detection method must be very precise and not the least it should be able to detect very low concentrations of the tracer arranged at the influx location. This situation is present when monitoring production fluids in for instance petroleum wells.

Thus one of the major obstacles upon monitoring well fluids is to provide a combination of an analytical method and a tracer which will allow the detection of very low concentrations. Native PEGs and their derivates respond very well to Mass Spectrometry (MS). By native PEG is meant PEG groups having two hydroxy end functional groups. The derivates may be complexed with various ions, and these adducts are directly measurable at levels down to sub ppb using MS in for instance an electrospray source. Ammonium in particular has been shown to provide beneficial properties in Ammonium-PEG derivates, in particular regarding the detection of said adducts.

A monitoring method for well fluids using truly monodisperse polymeric materials such as PEG derivates as tracers, is thus an object of the present invention. One may use LC, LC/MS, GC, GC/MS or the like or a combination of the above method with fluorescent methodology, however the present invention discloses the use of a solid phase extraction system for the isolation of the compounds to be detected. This method will allow the compounds to be concentrated to such a degree that concentrations of compounds down to low as 10^(−15) M is rendered possible In order for achieving the necessary resolution of tracers, often present at very low concentrations, it is useful to use a combination of measuring and separation methods. One of the methods showing the greatest promise in this regard is mass spectrometry. A mass spectrometer may thus detect such low concentrations. The mass spectrometer is well known in the art, however according to the present invention, and allows the precise detection of small differences in the molecular weight of the compounds to be analysed. This is a central aspect of the invention as this allows the detection of compounds having mainly the same chemical properties, but different masses. Given that the traces should react in the same manner to an external influence such as water intrusion, the chemical properties should be mainly identical such that they are released in the same manner. The method which now allows the detection of different masses will then furnish the required information in a simple manner.

A further advantage of using a mass spectrometer is that the molecules may be fractured such that each fragment may also be detected. This will allow for an even greater number of tracers to be produced, thus increasing the resolution of the detection grid.

In conjunction with the use of polyether alcohols according to the invention it has proven advantageous to isolate the polyether alcohols using a solid phase extraction system. Experimentation has shown that the polyether alcohols are recuperated near completely such that upon consequent elution the polyether alcohols may be recuperated almost completely. This allows the further concentration of the sample as far as sample size allows. Thus it has proven possible to detect concentrations of tracer down to concentrations as low as sub ppt and below. No previously known combination of tracer system and concentration method allows the detection of such low tracer concentrations.

In an embodiment of the invention the polyether alcohols are functionalised using one of a number of different functional groups. Some of the functional groups arranged for being added to the polyether alcohols will render the polyether alcohol derivates less susceptible to being retained in the SPE (Solid Phase Extraction). Thus according to an embodiment of the invention the samples may be pretreated such that the functional groups are removed before analysis. If, as described throughout, a sufficient number of unique single polyether alcohol tracers are used, one will be able to distinguish each released compound by the unique combination of polyether alcohol tracers, or in simple cases by the polyether alcohol tracer itself.

Combining the use of SPE systems with mass spectrometry will allow the determination of each class of truly monodisperse compound as the SPE column will isolate the compounds, whereas the mass spectrometer will allow the determination of each compound. This allows the detection and marking of very low concentrations of tracers, and thus the tracers may be used in fluid streams having very high throughputs. Additionally this will allow the tracers to be made very resistant to the occurrences which they are to measure. As minute quantities are measurable, the tracers may be made to last longer or less tracer may be used in each application. This is one of a number of major advantages of the present invention.

The method allows not only the detection of well fluid entry into the well, but furthermore to ascertain from which well section the entry has occurred. This is rendered possible by using codes comprising combinations of monodisperse molecules of different weights easily discernible by the abovementioned methods.

By using truly monodisperse PEGs and its derivates a large number of different tracers may be generated wherein the various tracer materials behave in a similar manner from a chemical point of view.

Possible Areas of Use

As the tracers are intended for the monitoring of various well fluids at different temperatures such as in petroleum wells, it may be important at high temperature that the tracers are protected prior to release into the fluid to be detected. This may be achieved by incorporation into a matrix which may be comprise an inorganic or organic polymer system. The matrix may have various shapes such as particles, and wherein these are enveloped by a secondary polymer, or wherein the tracer is incorporated therein in a homogeneous or inhomogeneous manner in a monolithic structure having a specified shape. When incorporated into the matrix the tracers will to some extent be protected against degradation. The matrix may in an embodiment of the invention be arranged for dissolving upon contact with the fluid to be detected. After having been released the residence time within the well will under normal operating conditions be limited to a few hours, thus the period between release and detection will be quite short. Within the well, the tracers will be quite stable as there is little oxygen within the well fluids such that the tracer will not be degraded.

Figure 4B:
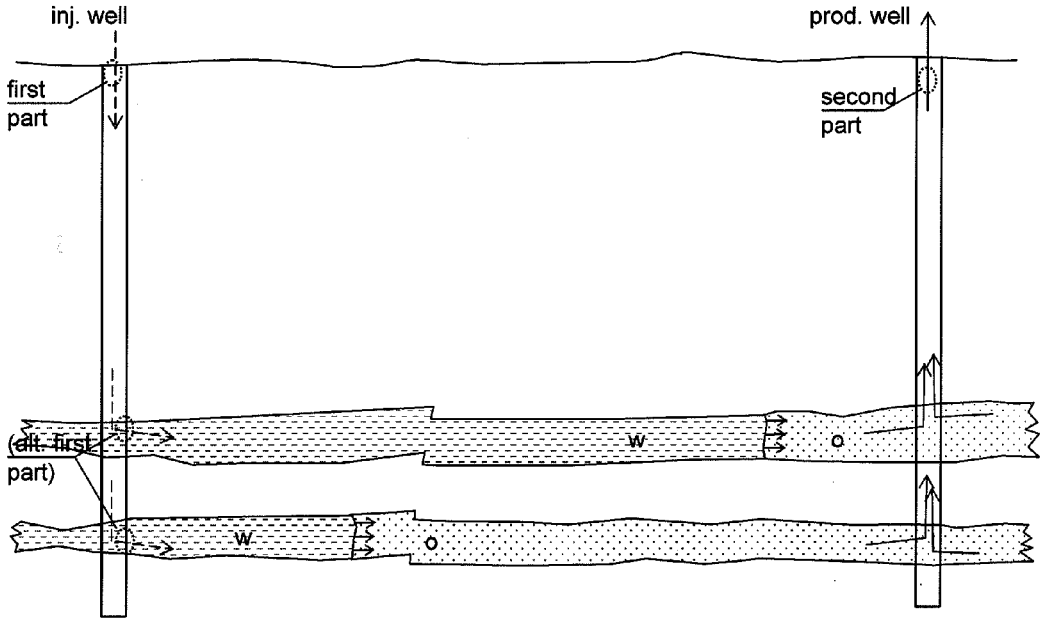
Figure 4C:
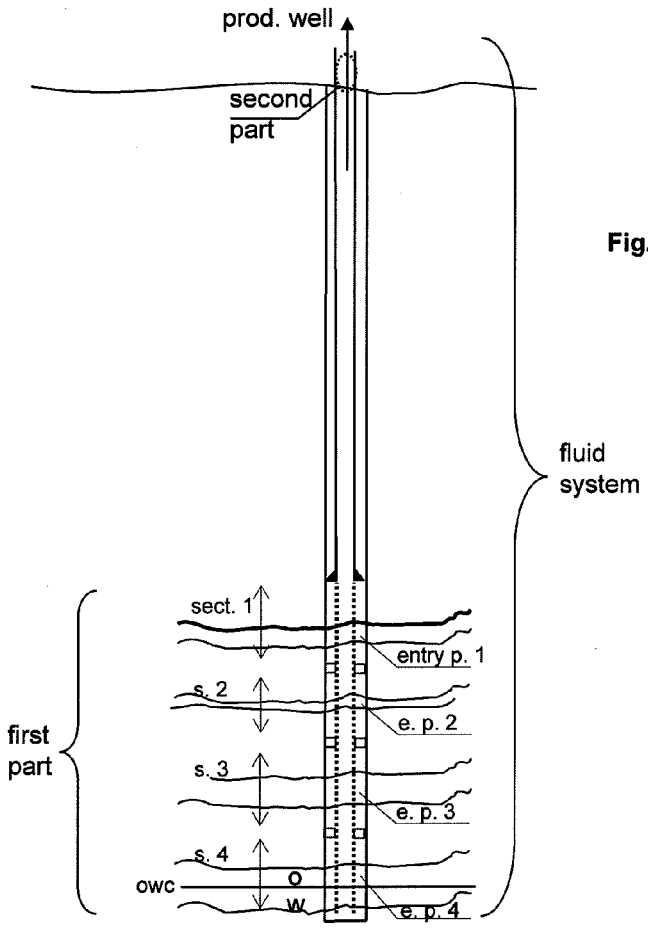

One of the major benefits of the invention is that it provides the ability to detect the entry point of a fluid into a conduit, in a precise and efficient manner. FIG. 4*c* illustrates a production well with four different possible entry points in the downhole first part of a production well. By conduit is meant any natural of manufactured manner in which a fluid flows between two points. Modern piping in use in wells now may comprise a plurality of layers, often comprising two concentric pipes, wherein the outer pipe is perforated, and wherein the entry point from the outer pipe into the inner and main conduit is controlled by a valve or the like. This allows each pipe section to be controlled separately, and sections and subsections of pipes may thus be shut off. As oilfields mature there is an increasing influx of water into production lines necessitating large amounts of separation of the produced fluids. Given this modern piping system, it is now possible to shut down separate pipe sections upon need. FIG. 4*c* provides an Illustration of a fluid system comprising a production in which the tracer system of the invention is arranged at different entry points downhole and in which the fluid system is sampled at the wellhead or further downstream.

Given that the oil water interface in a given well is not at the same level at all points due to faults or other geological phenomena, it is thus of importance to be able to identify the section from which the largest influx of water occurs. Evidently one may use oil soluble tracers for the detection of hydrocarbon influx, and in a corresponding manner as to the one described below, one may use these tracers for determining the areas wherefrom the highest oil influx occurs.

In order for achieving this goal the present invention describes a method wherein a coding system is used, wherein each section of pipe may be furnished with a specific combination of tracer materials. In order for achieving the desired specific codes it is necessary to have truly monodisperse polyether alcohol derivates, however the production of these are not the object of the present invention. Using these truly monodisperse polyether alcohol compounds, the following principle may be used.

Truly monodisperse polyether alcohol-units having distinct molecular weights are prepared for being arranged in specific places or baked into a tracer matrix for being arranged in specific places, in predefined combinations. The number of possible combinations of the truly monodisperse polyether alcohol compounds when using standard combinatory formulas is given as $$\text{Number of combinations} = \frac{n*(n-1)*(n-2)*\ldots*(n-(k-1))}{k!}.$$

In this equation n is the number of distinct tracer compounds, here truly monodisperse polyether alcohol compounds, from which one may chose. The number k represents the number of such distinct tracer compounds chosen. Taking for instance a combination of three distinct, truly monodisperse polyether alcohol compounds, taken from a sample space comprising 7 distinct such compounds in all would result in a number of possible combinatorial combinations equalling 35. FIG. 3 illustrates such a coded combination [5, 7, 10] of k=3 truly monodisperse polyethylene glycol compounds, out of n=7 available, which may represent a code "0101001". This would allow for a grid comprising 35 different sections that may be distinguished. Using n=14, and k=3 one arrives at as many as 364 combinations, and by increasing k to 4 one arrives at 1001 different codes. The number of distinct combinatorial tracer codes is thus increased very swiftly, and thus each section of the wells may be furnished with a specific code.

Instead of increasing k, it is equally simple to increase n to generate a high number of unique tracer combinations. This will result in a system being easier to analyse and thus to interpret the resulting data. Given a larger number of "base" tracer, e.g. n=25 or larger and k being small e.g. k=2, this will result in 300 unique tracers. Given n=50, 1225 distinct tracers may be obtained.

Upon analysis one is thus able to determine with precision the area from which the water influx occurs to a petroleum well and take appropriate action, for example by closing off the section wherefrom the water influx has occurred. Similarly but in an inverse situation using a lipophilic PEG one may determine with precision the influx point from which petroleum or pollutant influx occurs to one or more water supply wells or a water supply line.

Using derivisations of polyether alcohols such as PEG one may as mentioned above change the characteristics of the truly monidisperse polyether alcohol polymers, adding functionality to the tracers.

According to the present invention a plurality of tracer combinations may furthermore be introduced such that each combinatory tracer system is arranged for detecting a separate fluid. In this manner one may trace for instance water, oil and natural gas in a pipe.

Thus according to the present invention there is herein described a method for the detection of the intrusion point of a fluid in a conduit, wherein said method comprises the use of tracer combinations, wherein each conduit section is provided with a specific combination of tracers. It should be noted that for some applications the tracer combinations may comprise a single compound at each point, this is the equivalent of stating that k=1. This combination is a special combination which should be considered to form part of the invention. As an example of such a "combination", please see the single peak of the truly monodisperse PEG shown in FIG. 2 having almost uniquely the oligomer number 7.

Figure 4D:
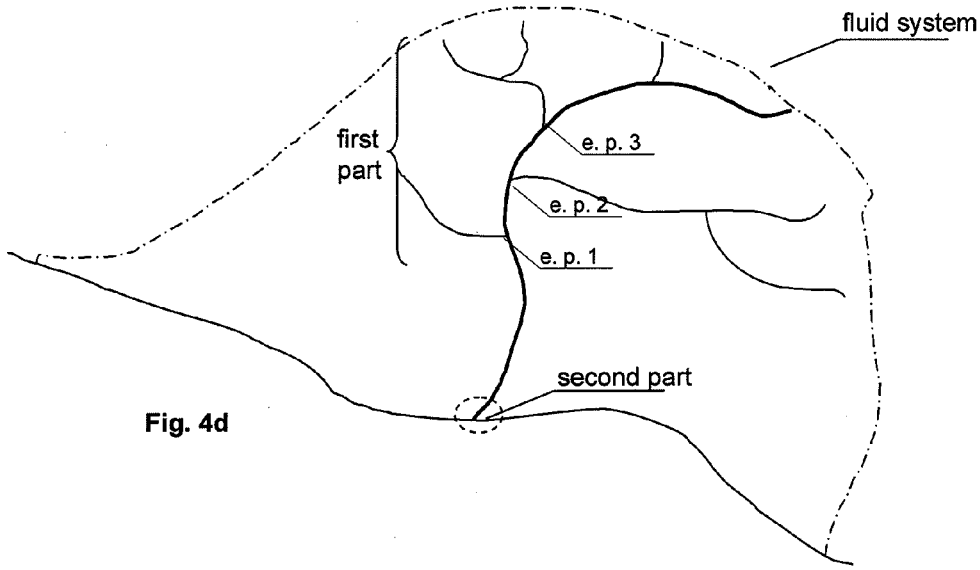

The method according to the present application may thus serve in a number of areas, including wells, production wells, well to well transportation, transportation piping, and even rivers or the like. FIG. 4*d* Illustrates a fluid system comprising a precipitation drainage area river fluid system in which the tracer system is arranged at different tributary streams and in which the fluid system is sampled at river mouth. The first part of the fluid system may comprise an upstream part of the fluid conduit, and the second part of the fluid system may comprise a downstream part of the fluid conduit. Upstream as used here means relatively nearer to (or behind) the fluid system's source or sources, and the term downstream signifies a part of the fluid system of which the fluid in the fluid system passes later. Given the versatility of the method there is practically no limit to the fluid to be detected, and one may easily envisage using the method for the detection of entry points of pollutants into streams or the like.

The placement of the tracers is furthermore of importance, and several different approaches may be considered. Squeezing the tracer materials into the formation using known methods is an alternative, although this might incur some issues regarding the stability of the materials. A better approach may be to place the tracer material within the piping, or if concentric piping is used, between the two pipes or the like. The tracer may for instance be placed within the gravel pack of an oil production pipe. The tracer material may also be placed at the well head, or be otherwise placed according to need. The applicant has previously filed several applications describing placement and use of tracers such as EP1277051 describing methods for placing tracer materials in wells. The methods described in this and other documents enables the person skilled in the art to apply the method according to the invention.

The method according to the invention is very well adapted for use in oil production pipes, however given the versatility of the truly monodisperse polyether alcohol-derivates, one may easily envisage using this coding method for a variety of applications. One may for instance mark the various industrial outlets into a river such that each compound is given a specific code. In this manner it will be easy to detect a specific pollutant and whether an industrial plant may be the source of the undesired outflow of the specified pollutant. The truly monodisperse polyether alcohol-polymers may be tailored to the degree that they may respond to various pollutants, or undesired incidences such that one achieves precise results pertaining to the relevant conduit section in which the incidence has occurred.

A separate area of use comprises using the tracer system the supervision of well integrity in a petroleum production well. Well integrity is a very large field which according to Norsok Standard D-010 may be defined as "the application of technical, operational and organizational solutions to reduce the risk of uncontrolled release of formation fluids throughout the entire life cycle of the well and of course safety aspects." As is evident this is a very broad definition, and given the life cycle of a well, this implies that tracer systems should be robust and long lasting. Additionally, given the large number of parameters that need to be monitored at all times, it is imperative that a large number of different tracers be provided. According to the present invention the number of tracers having similar chemical properties is very large, thus the tracer system of the present invention is particularly well adapted to the monitoring of well integrity.

A separate area of use comprises using the tracer system for well to well tracing. FIG. 4*b* is an Illustration of a fluid system comprising an injection well (left) in which the tracer system of the invention may be injected and a production well (right) of which the fluid system is sampled. Well to well tracing is of particular interest in petroleum production today as an increasing number of oil production wells depend at least partially on pressure support in order for a satisfactory level of production to be achieved. Pressure in a reservoir may be maintained by injecting a fluid through an injector well, creating a pressure front which more or less pushes the production fluids out through the production lines. However there is a risk associated with pressure support in wells, namely that the injection fluid will fracture the geological formation into which it is injected, and possibly even form a shortcut from the injection well to the production pipe. This situation will result in a major influx of injection fluid into the production pipe resulting in loss of efficiency. Furthermore it has proven difficult to uncover which injection well is responsible for the leakage of injection fluids through a formation into the production pipe if a plurality of injection wells have been used. The present invention allows the resolution of this problem by providing a number of tracer materials being easily detectable at low concentrations. One would simply provide each tracer to each injection well such that it would be simple to ascertain which injection well was responsible for the leakage.

Given the versatility of the tracer compounds, it is easy to envisage a number of other areas of use, such as the marking of fluids in tankers, the detection of inflows into a river, or any other area wherein tracers should be used. As described above, the tracer material may be modified in a number of manners such that it may detect a number of different occurrences, and even serve as a coding material.

Herein is thus presented a novel material class of tracers wherein said tracers are comprised within the group of truly monodisperse polyether alcohol, wherein said tracers comprise one or more functional groups for the detection of an incidence, and wherein the areas of use span many applications, and wherein the detection and separation of the tracers allow the detection very low concentrations of tracer materials.

The invention claimed is:

1. A tracer system comprising two or more tracer compounds for a petroleum production fluid transport system and an analyzing apparatus, wherein the fluid transport system comprises a conduit from a first part of the fluid transport system to a second part of the fluid transport system and the first part of the fluid transport system comprises two or more distinct entry points of one or more fluids to the conduit, wherein the fluid transport system is further subdivided into conduit sections and each conduit section comprises one or more of the distinct entry points, wherein the two or more tracer compounds each comprise a distinct combination of one or more monodisperse polyether alcohol compounds, wherein the one or more monodisperse polyether alcohol compounds have a distinct molecular weight and comprise one or more functional groups, wherein the tracer system is subdivided into two or more distinct combinations of the monodisperse polyether alcohol compounds, each combination corresponding to one subdivided conduit section of the fluid transport system, and wherein samples collected from the second part of the fluid transport system for analysis to determine the presence or absence of the one or more distinct combinations of monodisperse polyether alcohol compounds comprising the one or more functional groups in the one or more samples enables the determination of the one or more monodisperse polyether alcohol compounds having a distinct molecular weight each corresponding to one subdivided conduit section of the fluid transport system in the sample, based on detected monodisperse polyethyleneglycol compounds, and enables the determination of the subdivided conduit section of the fluid transport system comprising the entry point of the fluid present in the one or more samples.

2. The tracer system according to claim 1, wherein the one or more monodisperse polyether alcohol compounds is arranged for release to the fluid upon a change in a condition of the fluid.

3. The tracer system according to claim 1, wherein the two or more tracer compounds are arranged in a matrix, and the matrix is arranged for contact with the fluid.

4. The tracer system according to claim 1, comprising two or more distinct combinatorial combinations of two or more monodisperse polyether alcohol compounds.

5. The tracer system according to claim 2, wherein the change in the condition is a change in fluid inflow upon detection of the one or more monodisperse polyether alcohol compounds in the fluid.

6. The tracer system according to claim 1, wherein the one or more monodisperse polyether alcohol compounds comprises polyethyleneglycol or a derivative thereof.

7. The tracer system according to claim 1, wherein the one or more monodisperse polyether alcohol compounds comprises polypropyleneglycol or a derivative thereof.

8. The tracer system according to claim 6, wherein the one or more monodisperse polyether alcohol compounds comprise more than 3 monomer groups.

9. The tracer system according to claim 1, wherein the functional groups are arranged for increasing the hydrophilicity of the monodisperse polyether alcohol compounds.

10. The tracer system according to claim 1, wherein the functional groups are arranged for increasing the lipophilicity of the monodisperse polyether alcohol compounds.

11. The tracer system according to claim 9, wherein the one or more monodisperse polyether alcohol compounds have at least one functional group selected from the group consisting of a primary, secondary, tertiary and/or quaternary amine, a zwitterionic molecule, a hydroxyl, an amide, a carboxylic acid, a sulphonic acid and a phosphonic acid, or a salt thereof.

12. The tracer system according to claim 10, wherein the one or more monodisperse polyether alcohol compounds have at least one functional group selected from the group consisting of an aromatic hydrocarbon, a heterocyclic aromatic and a polycyclic aromatic hydro carbon.

13. The tracer system according to claim 1, wherein the functional groups are protection groups.

14. The tracer system according to claim 1, wherein the functional groups comprise a polymer.

15. The tracer system according to claim 1, wherein the functional groups comprise compounds having fluorescent properties.

16. The tracer system according to claim 1, further comprising a concentration system after sampling at the second part of the fluid transport system for concentrating one or more of the monodisperse polyether alcohol compounds from the fluid, wherein the concentration system comprises a solid phase extraction system.

17. The tracer system according to claim 1, wherein the analyzing apparatus for samples taken at the second part of the fluid transport system comprises a mass spectrograph.

18. The tracer system according to claim 2, wherein the change in the condition depends on one or more of the following: influx of water in oil, influx of oil or gas in water, influx of gas in oil, influx of salt water in oil, a temperature exceeding a limit, the presence of a specific chemical, and the presence of a specific pollutant.

19. The tracer system according to claim 2, wherein the change in the condition of the fluid is selected from the group consisting of (1) a detection of water entering the fluid transport system, (2) a change in temperature, (3) a change in pressure, (4) a change in salinity, (5) a change in pH, (6) a change in composition and (7) a mere displacement or transport of the fluid in the fluid transport system.

* * * * *